US010422536B2

(12) United States Patent
Binda et al.

(10) Patent No.: US 10,422,536 B2
(45) Date of Patent: Sep. 24, 2019

(54) DOMESTIC OVEN

(71) Applicant: WHIRLPOOL CORPORATION, Benton Harbor, MI (US)

(72) Inventors: Stefano Binda, Cassinetta (IT); Marco Giuliani, Cassinetta (IT); Cristina Mazzetti, Cassinetta (IT)

(73) Assignee: Whirlpool Corporation, Benton Harbor, MI (US)

( * ) Notice: Subject to any disclaimer, the term of this patent is extended or adjusted under 35 U.S.C. 154(b) by 556 days.

(21) Appl. No.: 15/176,738

(22) Filed: Jun. 8, 2016

(65) Prior Publication Data

US 2016/0356503 A1 Dec. 8, 2016

(30) Foreign Application Priority Data

Jun. 8, 2015 (EP) ..... 15171069

(51) Int. Cl.
*F24C 15/04* (2006.01)
*F24C 15/02* (2006.01)
*F24C 15/10* (2006.01)

(52) U.S. Cl.
CPC ..... *F24C 15/021* (2013.01); *F24C 15/024* (2013.01); *F24C 15/028* (2013.01); *F24C 15/045* (2013.01); *F24C 15/104* (2013.01)

(58) Field of Classification Search
CPC ..... F24C 15/021; F24C 15/006; F24C 15/024
See application file for complete search history.

(56) References Cited

U.S. PATENT DOCUMENTS

| | | | | |
|---|---|---|---|---|
| 5,562,090 | A | 10/1996 | Katz | |
| 2007/0158340 | A1* | 7/2007 | Kim | F24C 15/006 219/741 |
| 2007/0251520 | A1* | 11/2007 | Bang | F24C 15/022 126/200 |
| 2015/0101587 | A1* | 4/2015 | Hynes | A47F 3/0434 126/200 |

FOREIGN PATENT DOCUMENTS

| | | | |
|---|---|---|---|
| DE | 3602455 | A1 | 7/1987 |
| EP | 1179712 | A1 | 2/2002 |
| JP | S62213617 | A | 9/1987 |
| JP | 2007218508 | A | 8/2007 |

OTHER PUBLICATIONS

European Patent Office, European Search Report and Opinion for European Application No. 15171069.6-1605, dated Nov. 24, 2015, 7 pages.

* cited by examiner

*Primary Examiner* — Jason Lau
(74) *Attorney, Agent, or Firm* — Price Heneveld LLP

(57) ABSTRACT

A domestic oven is provided having a hinged door with a handle. The hinged door includes at least one external glass panel coupled to one or more vertical bars defining a structure of the hinged door and an elongated element is coupled to an upper edge of the at least one external glass panel. The elongated element is positioned between the structure and the handle with at least one external glass panel interposed therein.

18 Claims, 2 Drawing Sheets

DOMESTIC OVEN

CROSS-REFERENCE TO RELATED APPLICATION

This application claims priority to European Patent Application EP 15171069.6, filed Jun. 8, 2015, entitled "DOMESTIC OVEN," the disclosure of which is incorporated herein by reference in its entirety.

FIELD OF DISCLOSURE

The present disclosure generally relates to a domestic oven comprising a hinged door with an upper handle.

BACKGROUND

In modern built-in ovens the design of the door requires a very slim handle fixed at the top of the door glass. This creates a handle fastening problem since the holes in the glass panel for placing the screws that fix the handle to the glass panel cannot be placed too near the upper edge of the glass panel in order to avoid glass breaking problems.

As an example, in order to have holes with a 8 mm diameter, glass suppliers have limits on the dimensions for the top of the glass. In other words, such holes cannot have the center placed at a distance lower than 2 times the holes diameter plus glass edge radius from the edge of the glass panel (i.e. 20 mm for a hole 8 mm). If a slim handle is used, the slim handle will not be flush with the upper edge of the glass panel, and the end result will be a door with poor aesthetics.

Currently, to overcome the above limitations a terminal handle is attached with a shape according to each hole that is moved to a specified distance from the glass top. Even if such a solution can be considered good from a mechanical perspective, the overall aesthetic is affected by this technical feature.

There accordingly remains a need to overcome the above technical problems of attaching a slim handle to the glass panel of an oven door in an optimally aesthetic way. These problems are addressed by the present disclosure and the features listed in the appended claims.

SUMMARY

According to one aspect of the present disclosure, a domestic oven is provided having a hinged door with a handle. The hinged door includes at least one external glass panel coupled to one or more vertical metal bars defining a structure of the hinged door and an elongated element coupled to an upper edge of the at least one external glass panel. The elongated member is positioned between the structure and the handle with the at least one external glass panel interposed therein.

According to another aspect of the present disclosure, a domestic oven is provided having a hinged door with a handle. The hinged door includes at least one external glass panel coupled to one or more vertical metal bars defining a structure of the hinged door and an elongated element coupled to an upper edge of the at least one external glass panel. The elongated element is positioned between said structure and the handle with the interposition of the glass panel. The one or more vertical bars are positioned orthogonal to the elongated element, and are coupled to the external glass panel with a glue. The one or more vertical bars have an end extending above the upper edge of the external glass panel.

According to yet another aspect of the present disclosure, a domestic oven is provided having a hinged door with a handle. The hinged door includes at least one external glass panel coupled to one or more vertical metal bars defining a structure of the hinged door and an elongated element coupled to an upper edge of the at least one external glass panel. The elongated element is positioned between said structure and the handle with the at least one external glass panel interposed therein. The door includes an upper ventilation deflector coupled above the elongated element. An aesthetic serigraphy is coupled between the elongated element and the glass panel.

Further advantages and features of a domestic oven according to the disclosure will be clear from the detailed description, provided as non-limiting examples, with reference to the attached drawings herein.

DETAILED DESCRIPTION OF EMBODIMENTS

Figure 1:
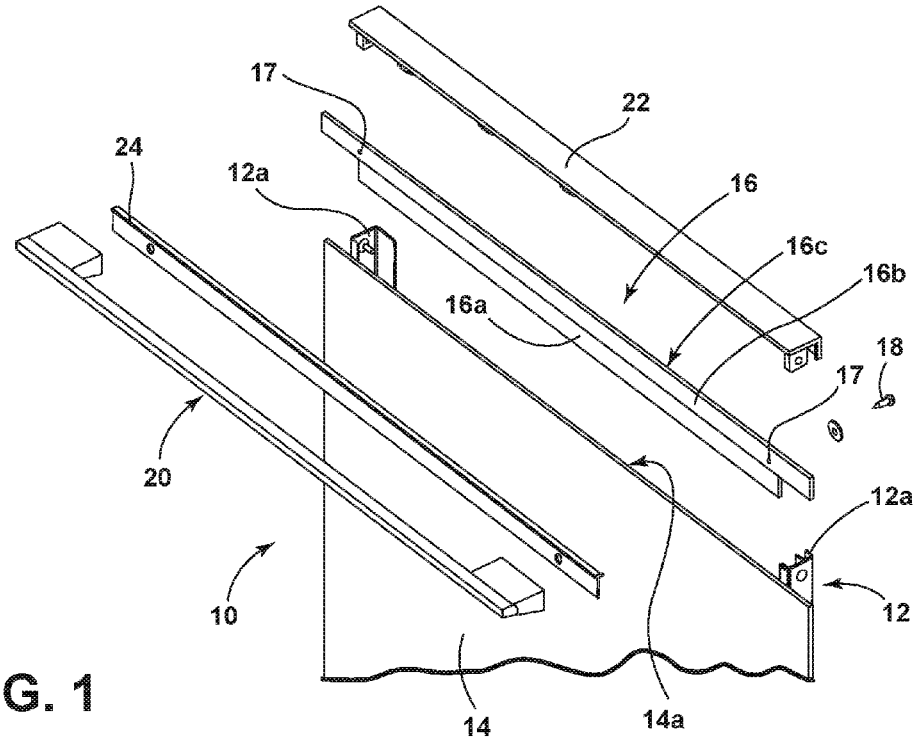
FIG. 1 is an exploded perspective view of a detail of a door of an oven according to a first embodiment of the disclosure with the use of a metal aesthetic cover below the handle.

For purposes of description herein, the terms "upper," "lower," "right," "left," "rear," "front," "vertical," "horizontal," and derivatives thereof shall relate to the device as oriented in FIG. 1. However, it is to be understood that the device may assume various alternative orientations and step sequences except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
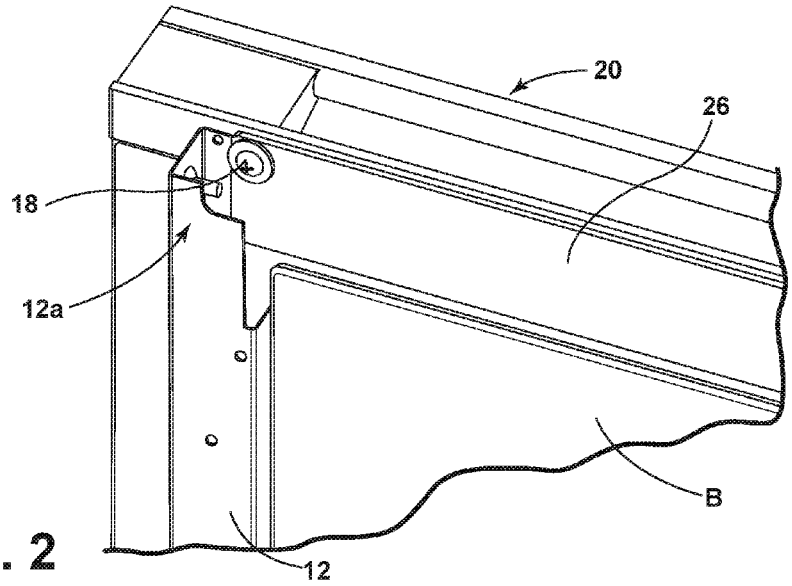
FIG. 2 is a detail of the door of FIG. 1 in an assembled configuration.

With reference to FIGS. 1-4, in particular FIGS. 1 and 2, a hinged door 10 of a domestic oven comprises one or more vertical metal bars 12 having a C section and defining the door structure. The one or more vertical metal bars 12 are glued or fastened to an external glass panel 14. The term "vertical," as used herein, is defined as the position of the one or more metal bars 12 in the closed oven hinged door 10. Other intermediate or internal glass panels may be provided, as shown with references B and C in the drawings.

According to embodiments of the present disclosure, the external glass panel 14 has an upper edge 14*a* which is lower than an upper end 12*a* of the vertical metal bars 12. This area is covered by an elongated element 16 orthogonal to the vertical metal bars 12, which presents a lower portion 16*a* glued to an upper zone 14*b* of the inner face of the external glass panel 14 and an upper portion 16*b* with an upper edge

16*c* at the same level of the upper ends 12*a* of the vertical metal bars 12. This upper portion 16*b* of the elongated element 16 is provided with one or more holes 17 for the passage of one or more screws 18 for fixing a slim handle 20 to the hinged door 10.

In some embodiments, the elongated element 16 can be made of a plastic, a metal, a ceramic, or a combination thereof. The type of glue is not limiting and can be a silicone glue, a super glue, a hot glue, a pressure sensitive glue, a spray glue, an epoxy glue, a polyurethane glue, or a combination thereof. On top of the elongated element 16, a door ventilation deflector 22 may be installed (not shown in FIG. 2 for clarity).

For hiding the difference of the materials making the glass panel 14 and the plastic elongated element 16, a cover 24 (for instance made of thin metal) is interposed between the elongated element 16 and the handle 20, with an external surface flush with the external glass panel 14. In some embodiments, the cover 24 can be a metal bar or a thin metal cover with various colors and dimensions to create a desired aesthetic effect. The metal bar or thin metal cover is coupled between the portion of the elongated element extending above the upper edge of the external glass panel and the handle.

Moreover, the upper zone 14*b* of the external glass panel 14 which is covered by the elongated element 16 glued thereto may be provided with an aesthetic serigraphy 26 (FIG. 2). The elongated element 16 may be glued to the glass panel 14 with the same glue, such as a silicone, that is used to fix the glass panel 14 to the vertical metal bars 12 used for structural support.

The oven hinged door 10 described herein gives a manufacturer or consumer a high degree of flexibility in managing aesthetic frame variants and in varying the shape of the handle.

Figure 3:
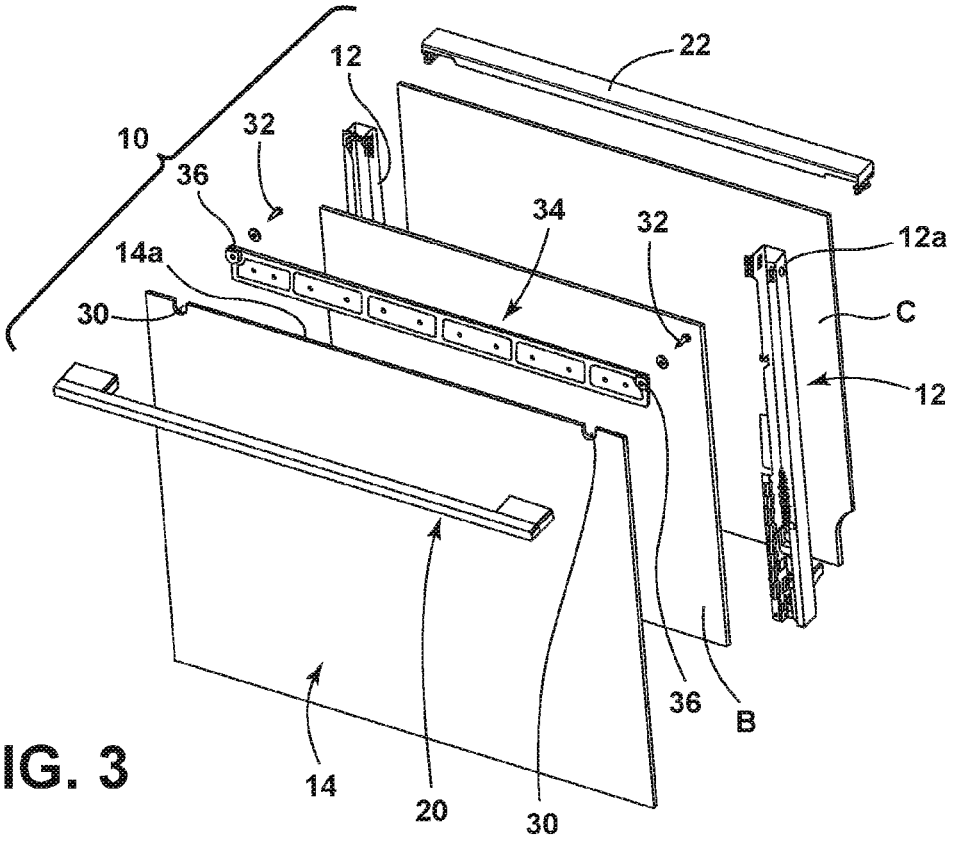
FIG. 3 is an exploded perspective view of a detail of a door of an oven according to a second embodiment of the disclosure with a full glass flat door.
Figure 4:
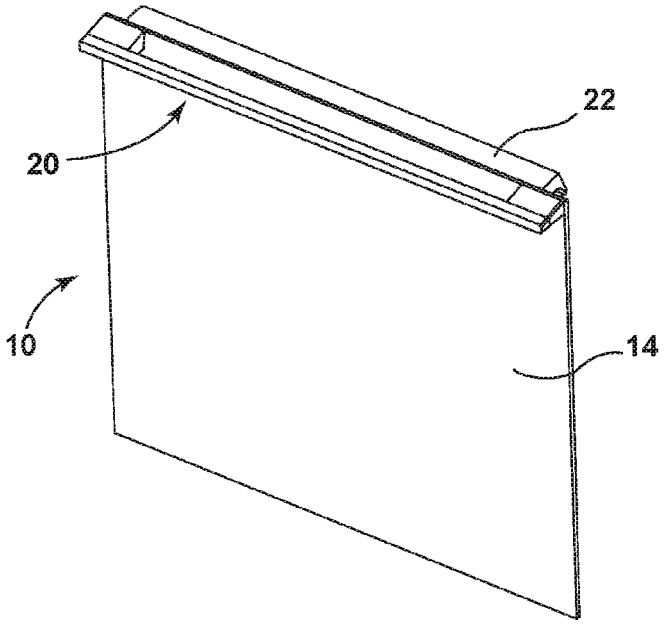
FIG. 4 is a detail of the door of FIG. 3 in an assembled configuration.

As illustrated in FIGS. 3 and 4, another embodiment of the disclosure is shown where the handle 20 is attached at the vertical metal bars 12 that replace a portion of the glass behind the handle.

In these types of embodiments, the upper edge 14*a* of the glass panel 14 is provided with one or more notches 30 for the passage of one or more fixing screws 32. An elongated attachment element 34 is glued to the upper zone 14*b* of the glass panel 14 so that its upper edge 34*a* is substantially flush with the upper edge 14*a* of the glass panel 14. The elongated attachment element 34 presents fixing holes 36 for the passage of the screws 32, and it can be made of polymeric material or of metal In some embodiments, the handle 20 appears to be attached directly to the external glass panel 14 without any additional parts visible.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

LISTING OF NON-LIMITING EMBODIMENTS

Embodiment A is a domestic oven comprising a hinged door with a handle, wherein the hinged door comprises at least one external glass panel coupled to one or more vertical metal bars defining a structure of the hinged door; and an elongated element coupled to an upper edge of the at least one external glass panel wherein the elongated element is positioned between the structure and the handle with the at least one external glass panel interposed therein.

The device of Embodiment A wherein the upper edge of the external glass panel is glued to the elongated element wherein a portion of the elongated element extends above the upper edge has one or more holes for coupling the handle to the hinged door.

The device of Embodiment A or Embodiment A with one or more of the intervening features wherein the elongated element is made of a polymeric material.

The device of Embodiment A or Embodiment A with one or more of the intervening features wherein a thin metal cover is coupled between the portion of the elongated element extending above the upper edge of the external glass panel and the handle.

The device of Embodiment A or Embodiment A with one or more of the intervening features wherein an aesthetic serigraphy is coupled between the elongated element and the external glass panel.

The device of Embodiment A or Embodiment A with one or more of the intervening features wherein the one or more vertical bars are positioned orthogonal to the elongated element and are coupled to the external glass panel with a glue; wherein the one or more vertical bars have an end extending above the upper edge of the external glass panel.

The device of Embodiment A or Embodiment A with one or more of the intervening features wherein the glue used for coupling the elongated element to the external glass panel is the same as the glue used for coupling the one or more vertical metal bars to the external glass panel.

The device of Embodiment A or Embodiment A with one or more of the intervening features wherein the external glass panel comprises one or more notches on the upper edge wherein a fastening means couples the handle and the elongated element to the structure of the door.

The device of Embodiment A or Embodiment A with one or more of the intervening features wherein the elongated element is coupled onto the upper portion of the glass panel with a glue.

The device of Embodiment A or Embodiment A with one or more of the intervening features wherein the one or more vertical bars are positioned orthogonal to the elongated element and are coupled to the external glass panel with a glue; wherein the one or more vertical bars have an end extending above the upper edge of the external glass panel.

The device of Embodiment A or Embodiment A with one or more of the intervening features wherein the door comprises an upper ventilation deflector coupled above the elongated element.

The device of Embodiment A or Embodiment A with one or more of the intervening features wherein the handle has a vertical dimension no greater than 30 mm.

Embodiment B is a domestic oven comprising a hinged door with a handle, wherein the hinged door comprises at least one external glass panel coupled to one or more vertical metal bars defining a structure of the hinged door; and an elongated element coupled to an upper edge of the at least one external glass panel wherein the elongated element is positioned between said structure and the handle with the interposition of the glass panel; wherein the one or more vertical bars are positioned orthogonal to the elongated element, and are coupled to the external glass panel with a glue wherein the one or more vertical bars have an end extending above the upper edge of the external glass panel.

The device of Embodiment B wherein the glue used for coupling the elongated element to the external glass panel is the same as the glue used for coupling the one or more vertical metal bars to the external glass panel.

The device of Embodiment B or Embodiment B with one or more of the intervening features wherein an aesthetic serigraphy is coupled between the elongated element and the glass panel.

The device of Embodiment B or Embodiment B with one or more of the intervening features wherein the handle has a vertical dimension no greater than 30 mm.

Embodiment C is a domestic oven comprising a hinged door with a handle, wherein the hinged door comprises at least one external glass panel coupled to one or more vertical metal bars defining a structure of the hinged door; and an elongated element coupled to an upper edge of the at least one external glass panel wherein the elongated element is positioned between said structure and the handle with the at least one external glass panel interposed therein; wherein the door comprises an upper ventilation deflector coupled above the elongated element; and wherein an aesthetic serigraphy is coupled between the elongated element and the glass panel.

The device of Embodiment C wherein the one or more vertical bars are positioned orthogonal to the elongated element and are coupled to the external glass panel with a glue, wherein the one or more vertical bars have an end extending above the upper edge of the external glass panel.

The device of Embodiment C or Embodiment C with one or more of the intervening features wherein the glue used for coupling the elongated element to the external glass panel is the same as the glue used for coupling the one or more vertical metal bars to the external glass panel.

The device of Embodiment C or Embodiment C with one or more of the intervening features wherein the upper edge of the external glass panel is coupled to the elongated element with a glue wherein a portion of the elongated element extends above the upper edge has one or more holes for coupling the handle to the hinged door.

The invention claimed is:

1. A domestic oven comprising:

a hinged door with a handle, wherein the hinged door comprises at least one external glass panel coupled to one or more vertical metal bars defining a structure of the hinged door;

an elongated element coupled to an upper edge of the at least one external glass panel, wherein the external glass panel comprises at least one notch on the upper edge, and wherein the elongated element is positioned between the structure and the handle with the at least one external glass panel interposed therein; and a fastener, wherein the fastener couples the handle and the elongated element to the structure of the hinged door.

2. The domestic oven of claim 1, wherein the upper edge of the external glass panel is glued to the elongated element, and wherein a portion of the elongated element extends above the upper edge and has one or more holes for coupling the handle to the hinged door.

3. The domestic oven of claim 1, wherein the elongated element is made of a polymeric material.

4. The domestic oven of claim 2, wherein a thin metal cover is coupled between the portion of the elongated element extending above the upper edge of the external glass panel and the handle.

5. The domestic oven of claim 2, wherein an aesthetic serigraphy is coupled between the elongated element and the external glass panel.

6. The domestic oven of claim 1, wherein the one or more vertical metal bars are positioned orthogonal to the elongated element and are coupled to the external glass panel with a glue.

7. The domestic oven of claim 1, wherein a glue is used for coupling the elongated element to the external glass panel.

8. The domestic oven of claim 1, wherein the elongated element is coupled onto the upper edge of the external glass panel with a glue.

9. The domestic oven of claim 1, wherein the one or more vertical metal bars have an end extending above the upper edge of the external glass panel.

10. The domestic oven of claim 1, wherein the door comprises an upper ventilation deflector coupled above the elongated element.

11. The domestic oven of claim 1, wherein the handle has a vertical dimension no greater than 30 mm.

12. A domestic oven comprising:

a hinged door with a handle, wherein the hinged door comprises at least one external glass panel coupled to one or more vertical metal bars defining a structure of the hinged door; and an elongated element coupled to an upper edge of the at least one external glass panel wherein the elongated element is positioned between said structure and the handle with the interposition of the external glass panel;

wherein the one or more vertical metal bars are positioned orthogonal to the elongated element, and are coupled to the external glass panel with a glue wherein the one or more vertical metal bars have an end extending above the upper edge of the external glass panel.

13. The domestic oven of claim 12, wherein a glue is used for coupling the elongated element to the external glass panel.

14. The domestic oven of claim 12, wherein an aesthetic serigraphy is coupled between the elongated element and the external glass panel.

15. The domestic oven of claim 12, wherein the handle has a vertical dimension no greater than 30 mm.

16. A domestic oven comprising:

a hinged door with a handle, wherein the hinged door comprises at least one external glass panel coupled to one or more vertical metal bars defining a structure of the hinged door; and an elongated element coupled to an upper edge of the at least one external glass panel with a glue, wherein the elongated element is positioned between said structure and the handle with the at least one external glass panel interposed therein;

wherein a portion of the elongated element extends above the upper edge has one or more holes for coupling the handle to the hinged door;

wherein the door comprises an upper ventilation deflector coupled above the elongated element; and wherein an aesthetic serigraphy is coupled between the elongated element and the external glass panel.

17. The domestic oven of claim 16, wherein the one or more vertical metal bars are positioned orthogonal to the elongated element and are coupled to the external glass panel with a glue, and wherein the one or more vertical metal bars have an end extending above the upper edge of the external glass panel.

18. The domestic oven of claim 17, wherein the glue used for coupling the elongated element to the external glass panel is the same as the glue used for coupling the one or more vertical metal bars to the external glass panel.

* * * * *